US005267387A

United States Patent [19]

Sawa

[11] Patent Number: 5,267,387

[45] Date of Patent: Dec. 7, 1993

[54] METHOD FOR HEMMING A WORKPIECE HAVING AN UPTURNED EDGE

[75] Inventor: Masazumi Sawa, Nagoya, Japan

[73] Assignee: Triengineering Co., Ltd., Nagoya, Japan

[21] Appl. No.: 51,528

[22] Filed: Apr. 22, 1993

Related U.S. Application Data

[63] Continuation-in-part of Ser. No. 920,718, Jul. 28, 1992, Pat. No. 5,224,253.

[30] Foreign Application Priority Data

Aug. 1, 1991 [JP] Japan ..... 3-216441

[51] Int. Cl.[5] ..... B23P 11/00

[52] U.S. Cl. ..... 29/509

[58] Field of Search ..... 29/238, 243.58, 283.5, 29/243.57, 897.2, 509, 513; 72/210, 220

[56] References Cited

FOREIGN PATENT DOCUMENTS 61-262432 11/1986 Japan .
1-249222 10/1989 Japan ..... 29/509
2-70325 3/1990 Japan ..... 72/220
2-280929 11/1990 Japan ..... 29/513

*Primary Examiner*—P. W. Echols
*Assistant Examiner*—David P. Bryant
*Attorney, Agent, or Firm*—Palmatier, Sjoquist & Helget

[57] ABSTRACT

A method for hemming a workpiece having an upturned edge, wherein the workpiece is composed of an outer panel having a peripheral upturned edge turned substantially at a right angle, and an inner panel having a peripheral edge superimposed on the outer panel adjacent the upturned edge. The upturned edge of the outer panel is bent preliminarily by a hem roller which is held on a guide surface of a lower die. The guide surface is so formed that when the hem roller is rotated on the guide surface, the hem roller abuts against the outer periphery of the upturned edge of the outer panel at a point at least a distance 2TO+TI apart from the lower end of the upturned edge toward the distal end thereof, wherein TO is thickness of the outer panel and TI is thickness of the inner panel. The hem roller is then shifted by a robot hand to a second position in which the hem roller is parallel to the superimposed portion of the inner panel. The upturned edge is finally bent by the hem roller in the second position until the upturned edge is superimposed on the peripheral edge of the inner panel.

3 Claims, 4 Drawing Sheets

METHOD FOR HEMMING A WORKPIECE HAVING AN UPTURNED EDGE

This is a division of U.S. application Ser. No. 07/920,718, filed Jul. 28, 1992, now U.S. Pat. No. 5,224,253.

BACKGROUND OF THE INVENTION

1. Field of the Invention

The present invention relates to a method and apparatus for hemming a workpiece such as a door panel and a hood panel for a vehicle.

2. Description of the Prior Art

Conventionally, as shown in FIGS. 8 and 9, peripheral edges, for example, of a door panel, a hood panel or the like for a vehicle are formed by hemming layers of an outer panel WO and an inner panel WI into an integral assembly. An example of a prior art apparatus to be used for such hemming is described in Japanese Laid-Open Patent Publication No. 61-262432 in which a roller type hemming apparatus is disclosed by the applicant of the present application.

The hemming apparatus includes a robot hand R (fragmentarily shown in FIGS. 8 and 9) having a predetermined traveling path which has been stored in advance and a hem roller r carried by the robot hand R, and is adapted to hem an upturned edge WE of a workpiece W by pressingly rotating the hem roller r along the upturned edge WE in such a manner as to accurately follow up the contour thereof. Thus, the hemming apparatus can carry out continuous hemming operation along the contour of the peripheral edge of the workpiece W, assuring satisfactory finish with improved hemming efficiency.

The outer panel WO has a peripheral edge preliminarily bent toward the inner panel WI substantially at right angles to form the above mentioned upturned edge WE (shown in a phantom line in FIG. 8) along which the hem roller r is pressingly rotated for hemming thereof. Such a hemming operation is generally carried out in two steps of a prebending process (FIG. 8) and a finish bending process (FIG. 9), and, in such a case, the hem roller r is controlled to rotate in such positions (i.e. tilt angles to the upturned edge WE) as to be suitable for the respective bending processes.

In the conventional prebending process, however, pressing force of the hem roller r is directly applied to the upturned edge WE, so that the upturned edge WE is bent sharply at its proximal end WE'. Such a sharp edge thus formed is disadvantageously left after finishing.

SUMMARY OF THE INVENTION

It is an object of the present invention to provide a method and apparatus for hemming a workpiece having an upturned edge which can solve the above problem and which can prevent formation of a sharp edge at a portion where hemming is carried out.

In order to solve the above problem, the present invention provides a method of hemming a workpiece having an upturned edge, wherein the workpiece is composed of an outer panel having a peripheral upturned edge turned substantially at right angles, and an inner panel having a peripheral edge to be superimposed on the outer panel adjacent the upturned edge. The method comprises the steps of providing a hem roller having a peripheral surface for pressing the upturned edge of the outer panel; providing a lower die on which the workpiece is supported, the lower die having a guide surface effective to hold the hem roller in a first position such that when the hem roller is rotated on the guide surface of the lower die, the pressing surface of the hem roller abuts against the outer periphery of the upturned edge of the outer panel at a point at least a distance 2TO+TI apart from the lower end of the upturned edge toward the distal end thereof, wherein TO is thickness of the outer panel and TI is thickness of the inner panel; rotating the hem roller along the guide surface of the lower die, thereby preliminarily bending the upturned edge to a predetermined angle; shifting the hem roller from the first position to a second position such that the pressing surface of the hem roller is substantially parallel to the superimposed portion of the outer panel and the inner panel; and pressingly rotating the hem roller along the upturned edge, thereby finishingly bending the upturned edge until the upturned edge is superimposed on the peripheral edge of the inner panel.

Also, in order to solve the above problem, the present invention provides an apparatus for hemming a workpiece having an upturned edge, wherein the workpiece is composed of an outer panel having a peripheral upturned edge turned substantially at right angles, and an inner panel having a peripheral edge to be superimposed on the outer panel adjacent the upturned edge. The apparatus comprises a hem roller having a peripheral surface for pressing the upturned edge of the outer panel; a robot hand rotatably supporting the hem roller and adapted to shift the hem roller between a first position in which the hem roller performs a preliminary bending operation on the upturned edge of the outer panel and a second position in which the hem roller performs a finish bedning operation on the upturned edge of the outer panel; and a lower die for supporting the workpiece thereon, the lower die having a guide surface effective to hold the hem roller in the first position such that when the hem roller is rotated on the guide surface of the lower die, the pressing surface of the hem roller abuts against the outer periphery of the upturned edge of the outer panel at a point at least a distance 2TO+TI apart from the lower end of the upturned edge toward the distal end thereof, wherein TO is thickness of the outer panel and TI is thickness of the inner panel; whereby when the hem roller is rotated along the guide surface of the lower die with the hem roller disposed in the first position, the upturned edge is preliminarily bent to a predetermined angle, and when the hem roller is pressingly rotated along the upturned edge with the hem roller shifted to the second position such that the pressing surface of the hem roller is substantially parallel to the superimposed portion of the outer panel and the inner panel, the upturned edge is finishingly bent until the upturned edge is superimposed on the peripheral edge of the inner panel.

In accordance with the above method and apparatus, the hem roller is pressingly rotated along the upturned edge through rotation thereof along the guide surface formed in the lower die, and the pressing force of the hem roller is not applied directly to the upturned edge.

Further, the guide surface is so designed as to cause the pressing surface of the hem roller to abut against the outer peripheral surface of the upturned edge a distance corresponding to at least the thickness of the hemmed portion apart from the proximal end toward the distal end thereof, and consequently, when the hem roller is pressingly rotated, the upturned edge is prebent at the abutting position, with the proximal end of the upturned edge held substantially at right angles instead of forming a sharp edge.

The invention will be more fully apparent from the following detailed description and appended claims when taken with the drawings.

DETAILED DESCRIPTION OF THE PREFERRED EMBODIMENT

Figure 1:
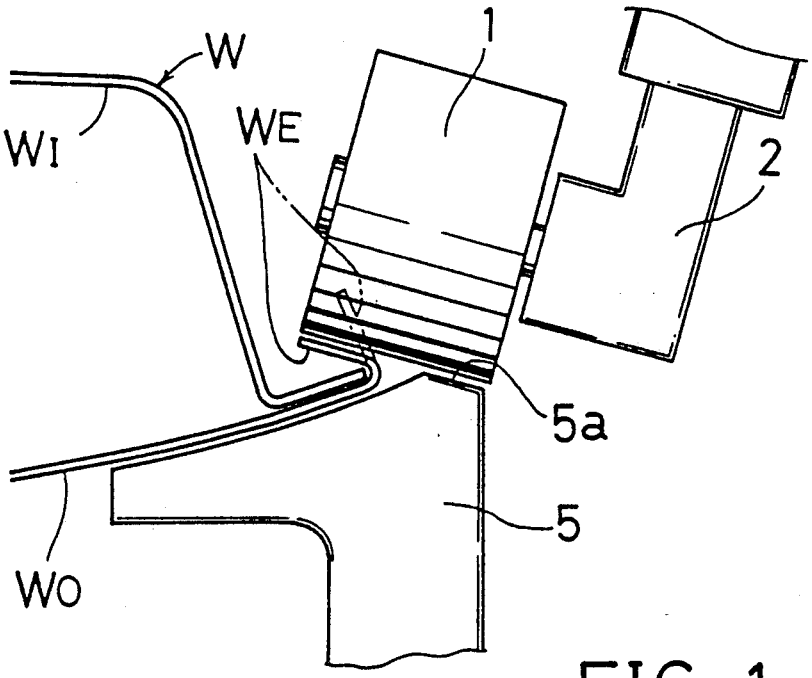
FIG. 1 is a side view of the arrangement for carrying out the method of the present invention, showing a hem roller in the prebending process.

Referring to the drawings and to FIG. 1 in particular, shown therein is the arrangement for carrying out the method of the present invention. As shown therein, a hem roller 1 for hemming a workpiece W is rotatably connected to a robot hand 2 having a predetermined traveling path which has been stored in advance. A lower die 5 is provided generally below the hem roller 1 and has a guide surface 5*a* formed by cutting a corner thereof in a descending manner.

The workpiece W is positioned between the hem roller 1 and the lower die 5. The workpiece W is composed of an outer panel WO and an inner panel WI. The outer panel WO has a peripheral edge bent substantially at right angles toward the inner panel WI to form an upturned edge WE (shown in phantom line in FIG. 1) prior to hemming operation which will be mentioned later in detail, and the inner panel WI has a peripheral edge arranged along the inside of the upturned edge WE.

Figure 2:
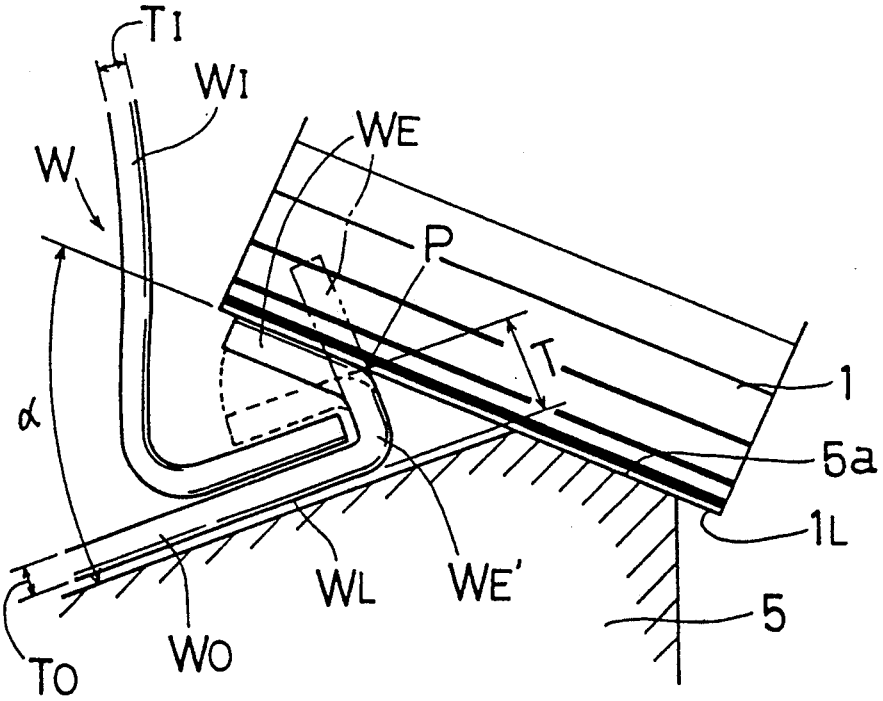
FIG. 2 is an enlarged side view of the essential parts of the present invention.
Figure 3:
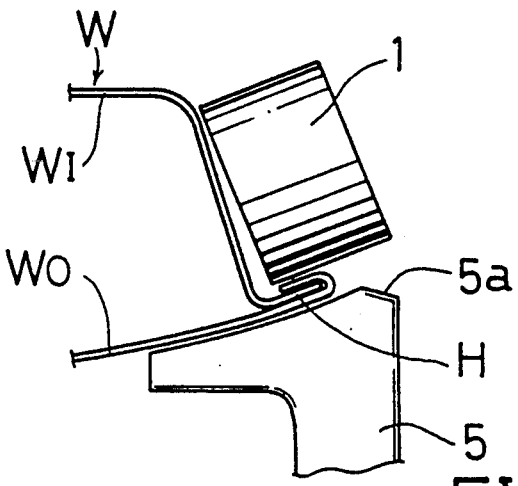
FIG. 3 is a side view showing the hem roller of FIG. 1 in the finish bending process.

The hemming operation is carried out in two steps of a prebending process (FIGS. 1 and 2) and a finish bending process (FIG. 3). To this end, the hem roller 1 is operated by the robot hand 2 to be pressingly rotated along the upturned edge WE of the workpiece W in such positions as to be suitable for the respective prebending and finish bending processes.

Referring to FIG. 2, the hem roller 1 is in a prebending position relative to the upturned edge WE of the workpiece W in the prebending process in FIG. 1.

The hem roller 1 is held at a predetermined prebending angle a. The prebending angle a is defined between the lower end surface 1L of the outer periphery of the hem roller 1 and the lower surface WL of the workpiece W that is the lower surface of the outer panel WO, and it may be, for example, in the order of 45 degrees.

In the prebending process, the hem roller 1 is rotated along the guide surface 5*a* of the lower die 5 in order to be pressingly rotated along the upturned edge WE. Here, the guide surface 5*a* is inclined such that when the hem roller 1 is rotated on the guide surface 5*a*, the lower end surface 1L of the hem roller 1 may abut against the outer periphery of the upturned edge WE at a position P in FIG. 2. The position P is in the outer periphery of the upturned edge WE a distance T apart upwardly along the outer periphery from the lower end thereof (or the lower surface WL of the workpiece W). The distance T is equal to the thickness of a hemmed portion H (FIG. 3) obtained after the hemming operation and is derived from the sum of the thickness TO of the outer panel WO×2 and the thickness TI of the inner panel WI.

The hemming apparatus thus constructed is operated as follows.

As shown in FIG. 2, in the prebending process, the hem roller 1 is held at the predetermined angle a to the upturned edge WE of the workpiece W and pressingly rotated therealong in abutment with the guide surface 5*a* of the lower die 5. This allows the upturned edge WE to be bent at the position P the distance T apart from the lower end thereof (or lower surface WL) and not at the proximal end WE′ thereof.

After the prebending process has been thus completed, the position of the hem roller 1 is shifted to a position for finish bending. As shown in FIG. 3, the hem roller 1 held in the finish bending position is again pressingly rotated along the upturned edge WE which has been prebent to carry out finish bending. Thus, the upturned edge WE is fully folded to complete the hemming operation, with the outer panel WO and the inner panel WI integrally assembled.

The hemmed portion H thus obtained through the above described hemming operation is bent at the position the distance T apart from the lower end toward the distal end, so that the proximal end WE′ does not form a sharp edge but is left substantially at right angles, assuring provision of the safe hemmed portion H.

In the above embodiment, the guide surface 5*a* is so designed as to cause the lower end surface 1L of the hem roller 1 to abut against the outer periphery of the upturned edge WE at the position P, but the position P may be more close to the distal end, and even in such a case, the proximal end WE′ is not bent but held substantially at right angles.

Figure 4:
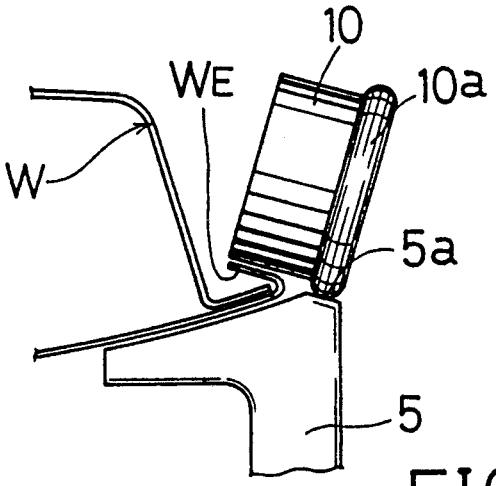
FIG. 4 is a side view of the hem roller of a second embodiment, showing the hem roller in the prebending process.
Figure 5:
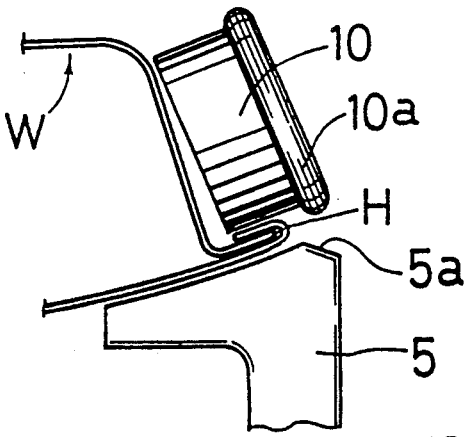
FIG. 5 is a side view showing the hem roller of FIG. 4 in the finish bending process.

FIGS. 4 and 5 show a second embodiment of the present invention. The difference in the second embodiment is that the hem roller 1 of the first embodiment is modified. Like parts are given like reference numbers, though the robot hand 2 of the first embodiment is not shown in FIGS. 4 and 5.

As shown in FIG. 4, a hem roller 10 is provided around the rear end thereof (the right side as viewed in FIG. 4) with a guide flange 10*a* of a semicircular configuration in section. Prebending is carried out through rotation of the guide flange 10*a* along the guide surface 5*a* formed on the lower die 5 to guide the rotating movement of the hem roller 10. As in the first embodiment, the bending position P of the upturned edge WE is defined at least above the distance T, so that the proximal end WE′ of the upturned edge WE is left substantially at right angles. Thus, after finish bending process, the hemmed portion H is not sharpened but properly rounded.

In this embodiment, when the hem roller 10 is held in a predetermined prebending position, with the guide flange 10*a* in abutment with the guide surface 5*a*, the guide flange 10*a* may abut against the upturned edge WE of the workpiece W at a position above the position P.

Further, the guide flange 10*a* of the hem roller 10, which is of a semicircular configuration in section, accommodates any change of the prebending angle, so that the hem roller 10 may be pressingly rotated along the upturned edge WE with the guide flange 10*a* continuously held in rotational abutment with the guide surface 5*a*.

Figure 6:
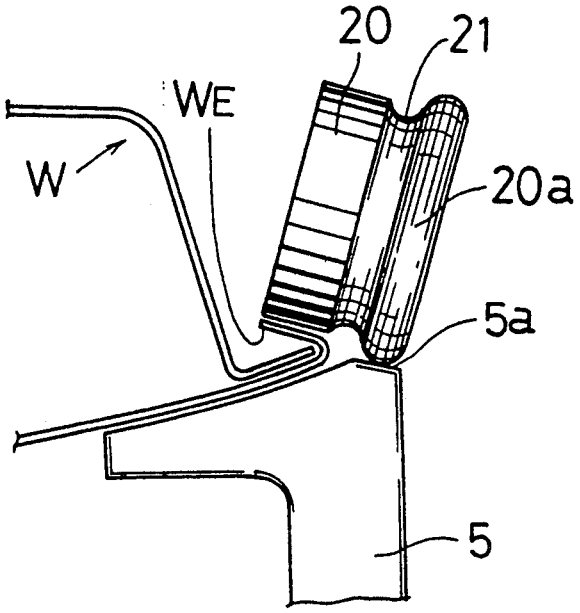
FIG. 6 is a side view of the hem roller of a third embodiment, showing the hem roller in the prebending process.
Figure 7:
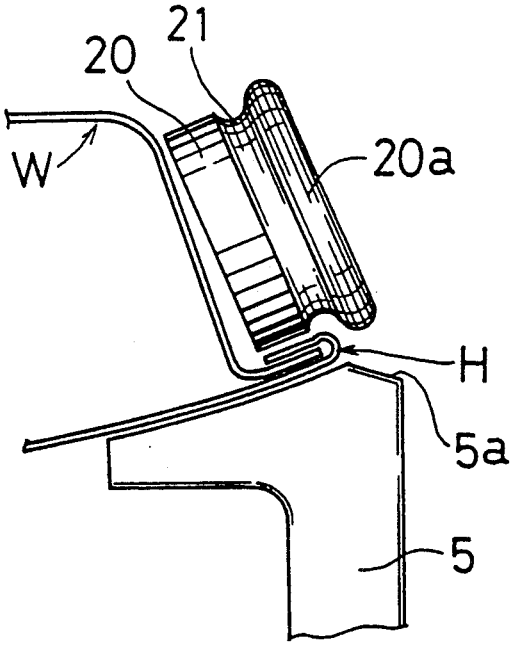
FIG. 7 is a side view showing the hem roller of FIG. 6 in the finish bending process.
Figure 8:
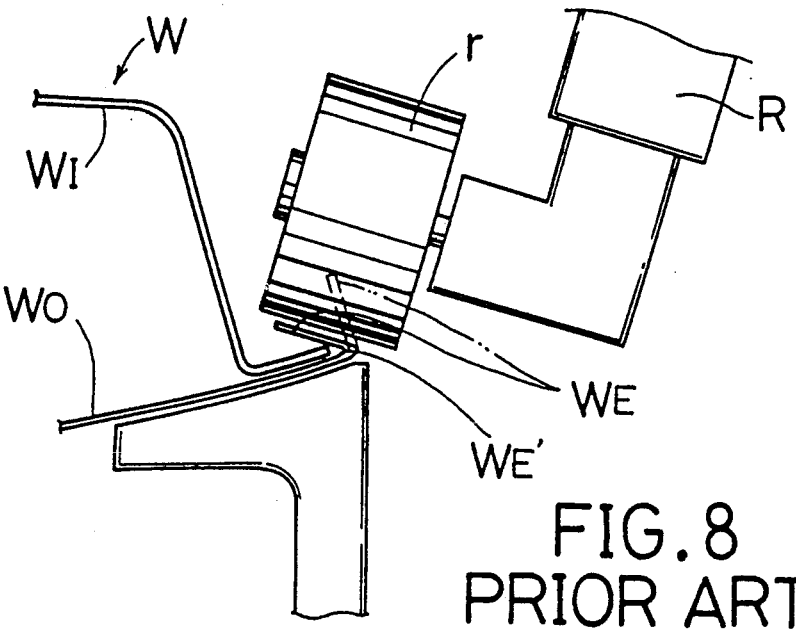
FIG. 8 PRIOR ART
FIG. 8 is a side view of the hem roller in the prebending process pressingly rotated in accordance with the prior art method.
Figure 9:
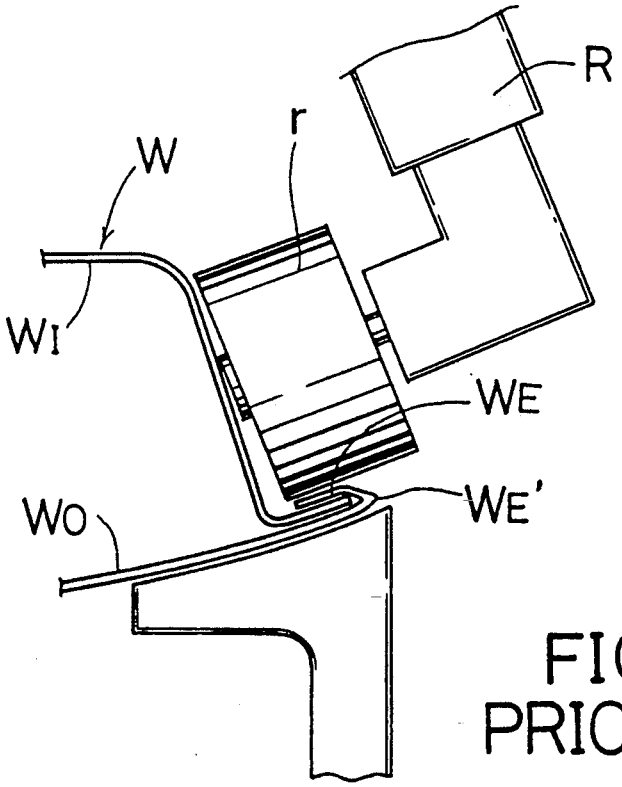
FIG. 9 PRIOR ART
FIG. 9 is a view similar to FIG. 8 but illustrating the finish bending process.

FIGS. 6 and 7 show a second embodiment of the present invention. The difference in the third embodiment is that the hem roller 10 of the second embodiment is modified. Like parts are given like reference numbers.

As shown in FIG. 6, a hem roller 20 is provided with a guide flange 20*a* corresponding to the guide flange 10*a* of the second embodiment and a relief groove 21 formed along the guide flange 20*a*. The relief groove 21 is of a semicircular configuration in section and extends along the guide flange 20*a* inwardly adjacent thereto.

The relief groove 21 thus provided at a predetermined position of the hem roller 20 is effective to prevent the corner of the upturned edge WE from being pressed down in the finish bending process, so that the upturned edge WE can be bent in a curved corner which provides a more positively rounded hemmed portion H in comparison with the ones formed in the first and second embodiments.

The relief groove 21 is not necessarily provided along with the guide flange 20*a* in the second embodiment, but it may be provided in the hem roller 1 of the first embodiment with a similar efficiency.

As described above, the present invention prevents a hemmed product from being formed with sharp outer peripheries, assuring provision of the hemmed product having improved safety.

While the invention has been described with reference to preferred embodiments thereof, it is to be understood that modifications or variations may be easily made without departing from the scope of the present invention which is defined by the appended claims.

What is claimed is:

1. A method of hemming a workpiece having an upturned edge, wherein the workpiece is composed of an outer panel having a peripheral upturned edge turned substantially at a right angle, and an inner panel having a peripheral edge superimposed on the outer panel adjacent the upturned edge, the method comprising the steps of:

providing a hem roller having a peripheral surface for pressing the upturned edge of the outer panel;

providing a lower die on which the workpiece is supported, the lower die having a guide surface effective to hold the hem roller in a first position such that when the hem roller is rotated on the guide surface of the lower die, the pressing surface of the hem roller abuts against the outer periphery of the upturned edge of the outer panel at a point at least a distance 2TO+TI apart from the lower end of the upturned edge toward the distal end thereof, wherein TO is thickness of the outer panel and TI is thickness of the inner panel;

rotating the hem roller along the guide surface of the lower die, thereby preliminarily bending the upturned edge to a predetermined angle;

shifting the hem roller from the first position to a second position such that the pressing surface of the hem roller is substantially parallel to the superimposed portion of the inner panel; and pressingly rotating the hem roller along the upturned edge, thereby finishingly bending the upturned edge until the upturned edge is superimposed on the peripheral edge of the inner panel.

2. The method as defined in claim 1 wherein the hem roller is formed around the outer periphery thereof with a guide flange of a semicircular configuration in section, the hem roller being pressingly rotated along the upturned edge of the workpiece with the guide flange held in abutment with the guide surface of the lower die.

3. The method as defined in claim 1 wherein the hem roller is formed around the outer periphery thereof with a relief groove, so that, when the hem roller is pressingly rotated along the upturned edge for finish bending, the upturned edge is folded in a curve after the relief groove.

* * * * *

UNITED STATES PATENT AND TRADEMARK OFFICE

CERTIFICATE OF CORRECTION

PATENT NO. : 5,267,387

DATED : December 7, 1993

INVENTOR(S) : Masazumi Sawa

It is certified that error appears in the above-identified patent and that said Letters Patent is hereby corrected as shown below:

Column 3, line 66, "angle a" (both instances) should be -- angle $\alpha$ --.

Column 4, line 23, "angle a" should be -- angle $\alpha$ --.

Claim 3, column 6, line 45, "after" should be -- along --.

Signed and Sealed this

Twenty-fourth Day of May, 1994

Bruce Lehman

*Attest:*

BRUCE LEHMAN

*Attesting Officer*

*Commissioner of Patents and Trademarks*